US007399503B2

(12) United States Patent
Holzapfel et al.

(10) Patent No.: US 7,399,503 B2
(45) Date of Patent: Jul. 15, 2008

(54) PROCESS FOR PRODUCING MULTI-LAYER COATING WHEREIN THE QUOTIENT OF THE SURFACE ENERGIES OF A SECOND COATING LAYER DIVIDED BY A FIRST COATING LAYER IS LESS-THAN-OR-EQUAL-TO 1

(75) Inventors: Klaus Holzapfel, Ascheberg (DE); Peter Mayenfels, Münster (DE); Hubert Baumgart, Münster (DE); Theodora Dirking, Münster (DE)

(73) Assignee: BASF Coatings AG, Munster (DE)

( * ) Notice: Subject to any disclaimer, the term of this patent is extended or adjusted under 35 U.S.C. 154(b) by 0 days.

(21) Appl. No.: 10/545,389

(22) PCT Filed: Jan. 30, 2004

(86) PCT No.: PCT/EP2004/000851

§ 371 (c)(1),
(2), (4) Date: Aug. 12, 2005

(87) PCT Pub. No.: WO2004/071678

PCT Pub. Date: Aug. 26, 2004

(65) Prior Publication Data

US 2006/0083860 A1 Apr. 20, 2006

(30) Foreign Application Priority Data

Feb. 15, 2003 (DE) ..... 103 06 357

(51) Int. Cl.
*B05D 5/00* (2006.01)
*B05D 7/14* (2006.01)
*B05D 3/08* (2006.01)
*B05D 3/10* (2006.01)
*B05D 3/14* (2006.01)

(52) U.S. Cl. ..... 427/402; 427/407.1; 427/409; 427/412.1; 427/535; 427/569; 427/508; 427/223; 427/224

(58) Field of Classification Search ..... None
See application file for complete search history.

(56) References Cited

U.S. PATENT DOCUMENTS

| | | | | | |
|---|---|---|---|---|---|
| 4,567,106 | A | * | 1/1986 | Sano et al. | 428/413 |
| 4,980,196 | A | * | 12/1990 | Yasuda et al. | 427/539 |
| 5,154,978 | A | * | 10/1992 | Nakayama et al. | 428/469 |
| 6,214,422 | B1 | | 4/2001 | Yializis | 427/488 |
| 2004/0131793 | A1 | | 7/2004 | Bier et al. | 427/535 |

FOREIGN PATENT DOCUMENTS

| | | | | |
|---|---|---|---|---|
| DE | 102 42 177 | | | 3/2004 |
| GB | 1 218 042 | A | * | 1/1971 |
| GB | 1218042 | | | 1/1971 |
| WO | WO2004/031272 | | | 4/2004 |

* cited by examiner

*Primary Examiner*—William P Fletcher, III

(57) ABSTRACT

Process for producing a multilayer coating, in which a first coating (A) has applied to it a subsequent coating material (B) which is then cured involves selecting and/or modifying the first coating (A) and/or selecting the coating material (B) in such a way that the quotient (Q) formed from the surface energy of the second coating (B) and the surface energy of the first coating (A) is less than or equal to 1, and its use.

18 Claims, No Drawings

PROCESS FOR PRODUCING MULTI-LAYER COATING WHEREIN THE QUOTIENT OF THE SURFACE ENERGIES OF A SECOND COATING LAYER DIVIDED BY A FIRST COATING LAYER IS LESS-THAN-OR-EQUAL-TO 1

CROSS REFERENCE TO RELATED APPLICATIONS

This application is a National Phase Application of Patent Application PCT/EP2004/000851, filed on 30, Jan. 2004, which claims priority to DE 103 06 357.9, filed on 15, Feb. 2003.

The present invention relates to a process for producing a multilayer coating, e.g. a multicoat paint system, in which a first coating (A) has applied to it a subsequent coating material (B), which is then cured, and to its use.

For a production-line vehicle paint system, in particular a high-quality automotive OEM finish, as is known, multicoat color and/or effect paint systems are used which are composed of primer, electrocoat, surfacer or antistonechip primer, basecoat and clearcoat. The clearcoats must meet stringent requirements in terms of optical and esthetic properties (appearance) and of hardness, scratch resistance, chemical resistance, etch resistance, and weathering stability.

A refinish is subject to the same requirements in respect of the properties as the OEM finish; that is, high resistance properties with respect to the effects of weathering, to chemicals and to mechanical loads are expected (see above). Refinishes involve alternatively an aftercoating or overcoating of an area of an automobile which has been damaged as a result of an accident, for example, or a graduated finish, or a complete overcoating of an automobile which has already been painted, owing to paint work damage, color differences or other unwanted defects in the paint already applied. The paint used for the refinish must adhere to the topmost coat of the original finish (OEM finish) and wet it completely. The intention here is to avoid laborious mechanical pretreatment such as sanding. For the OEM finish, the paints used for the top and bottom coats can be matched to one another during their preparation, so that effective wetting and adhesion are normally ensured. Such matching is not possible in the case of refinish. First, wetting/adhesion on the topmost topcoat of the OEM finish by the refinish paint is difficult to achieve owing to the (required) properties of the topcoat. The topcoat, in fact, is highly crosslinked, apolar, unreactive and inert.

Second, the refinish paint must at the same time adhere to the lower coats as well, if the overlying coats have flaked off. And, thirdly, the refinish paints have to be cured at relatively low temperatures, so as not to impair parts on the vehicle that are made of plastic or rubber. Accordingly, those coating materials curable with actinic radiation or with both actinic and thermal radiation would be preferable for such tasks, being curable at low temperatures.

On the basis of their special properties, the use of these coating materials in the automotive industry is particularly desirable. They exhibit particularly good gloss, high hardness, excellent weathering stability, and good scratch resistance.

Nevertheless, the use of these coating materials as OEM paints in the automobile industry has been hindered to date by the poor adhesion of a paint film to be applied thereto subsequently and by the inadequate wetting of the coatings produced with these coating materials.

Effective wetting of the (lower) coating by the subsequently applied coating material, and excellent subsequent adhesion of the cured coating material to the coating, however, are necessary in order for a further coating material, e.g., topcoat material, to be applied to the lower coating or in order to carry out a refinish and to obtain a permanent bond between the coats and, accordingly, a multilayer coating of high quality and durability.

The same is true of refinish systems, and especially when refinishing multicoat paint systems composed of primer, electrocoat, surfacer or antistonechip primer, basecoat, and clearcoat. Thus, in the case for example of only slight damage to the clearcoat, refinishing requires the latter to be overcoated with itself, with attendant problems of wetting and of subsequent adhesion (see above) as a result of the different properties of the cured clearcoat and of the liquid clearcoat material still to be applied. These problems are exacerbated when not only the clearcoat but also other, underlying coats have flaked off and must likewise be refinished or reconstructed in order to maintain the overall appearance.

EP 0349749 A1 discloses the use of a plasma pretreatment of painted components in order to enhance the adhesion properties of a second paint coat to be applied subsequently. As to what the ratio of the surface tensions should be, nothing is said. Nor is there any disclosure of its application to coatings cured with actinic radiation or both thermally and with actinic radiation.

It is an object of the present invention, therefore, to provide a novel process for producing multilayer coatings which no longer has the disadvantages of the prior art but which instead can be employed substantially independently of the prevailing conditions, particularly as regards temperature and atmospheric humidity, and even under extreme conditions. In such a process, any coat to be applied subsequently should adhere well to the previous coat, and should also wet it completely.

In particular, the new process ought to allow the coating to be refinished, and the refinished area thus obtained ought not to suffer any damage and to give a durable refinish of high quality at both high and low temperatures, high and low atmospheric humidity, and also under conditions fluctuating rapidly between these extremes, such as are dominant in tropical and desert climates, under high radiative intensity and under intensive mechanical and chemical loads, irrespective of the layer of the multilayer coating to which the coating material used for refinishing is applied.

The novel process ought in particular to be reliably applicable over as large a selection of coatings and coating materials as possible, particular attention being placed on the coating materials curable or coatings cured by means of actinic radiation.

The invention accordingly provides a process for producing a multilayer coating, in which a first coating (A) has applied to it a subsequent coating material (B) which is then cured, which involves selecting and/or modifying the first coating (A) and/or selecting the coating material (B) in such a way that the quotient (Q) formed from the surface energy of the second coating (B) and the surface energy of the first coating (A) is less than or equal to 1.

The quotient Q is calculated by dividing the surface energy of the second coating (B) by the surface energy of the coating (A).

The process of the invention allows effective wetting of the lower coating (A) by the subsequently applied coating material (B) and also excellent subsequent adhesion of the coating (B) to the coating (A).

Furthermore, as a result of the process of the invention, it becomes possible to produce a multilayer coating substantially independently of the prevailing conditions, particularly as regards temperature and atmospheric humidity, and even under extreme conditions. Any coat to be applied subsequently adheres well to the previous coat and wets it completely.

In addition, the refinishability of the coating is enhanced as a result of the novel process. The refinished area obtained in this way is durable under high and low temperatures, high and low atmospheric humidity, and also under conditions fluctuating rapidly between these extremes, such as occur in tropical or desert climates, and suffers no damage under high radiative intensity and under intense mechanical and chemical load, but instead produces a durable refinish of high quality, irrespective of the coat of the multilayer coating to which the coating material is applied.

Furthermore, the process of the invention makes overcoating or refinishing successful, since wettability and subsequent adhesion are guaranteed. Indeed, through the teaching according to the invention, the coating practitioner is instructed that he or she can ensure the success of his or her coating in terms of wetting and adhesion by setting the quotient Q at a value of less than or equal to 1, preferably less than or equal to 0.95, and in particular 0.9.

The quotient Q can be set by selecting and/or modifying the coating (A) and/or the coating material (B), such as is normally done in the case of an original, OEM finish composed of basecoat and clearcoat.

Should this not be possible or desirable, because, for example, a different appearance is produced or over-coating of the coating material with itself is required, the quotient Q can also be set by modifying the coating (A), in particular the surface of the coating (A). For this purpose it is possible to employ one or a combination of the following surface treatment methods: low-pressure plasma technology, atmospheric-pressure plasma technology, flaming, fluorination, silicatization.

Further, the coating (A) may be treated with liquid primers by means, for example, of dipping, spraying or brushing. It is also possible to use dielectric barrier discharge (corona) for the surface treatment.

The methods referred to are familiar to the skilled worker and may be found in the following references (Römpp Lexikon Lacke und Druckfarben, Georg Thieme Verlag Stuttgart, 1998, page 416 "Surface tension"), plasma treatment (Römpp Lexikon Lacke und Druckfarben, Georg Thieme Verlag Stuttgart, 1998, page 455 "Plasma treatment", PLASMATREAT®, brochure, AGRODYN Hochspannungstechnik GmbH), flaming (Römpp Lexikon Lacke und Druckfarben, Georg Thieme Verlag Stuttgart, 1998, page 59 "Flaming"; Automatic flamer model S 4S 300/2000 from Friedrich Schäfer Maschinenbaugesellschaft mbH, Sprendlingen), Fluorination (Römpp Lexikon Lacke und Druckfarben, Georg Thieme Verlag Stuttgart, 1998, page 0.244 "Fluorination"), silicatization, primer coating (Römpp Lexikon Lacke und Druckfarben, Georg Thieme Verlag Stuttgart, 1998, page 472 "Primer"), dielectric barrier discharge (Römpp Lexikon Lacke und Druckfarben, Georg Thieme Verlag Stuttgart, 1998, page 117 "Corona").

In one particularly preferred variant of the process the surface energy of the first coating (A) is modified and/or selected, in order to set the quotient Q, such that it is >30, preferably >40, and in particular >50 mJ/m$^2$. In that case, particularly good wetting and subsequent adhesion are likewise obtained.

Surface tension is a name for the interfacial tension of solids and liquids with respect to the vapor phase or air. It is defined as force per unit length, has the dimension mN/m, and in terms of dimension and value is equal to the surface energy required either actually to form the surface or to increase it under reversible conditions and isothermally. Under certain conditions, the surface tension corresponds to the free energy of the surface per unit area (surface energy in mJ/m$^2$). The surface energy of solids can be measured, inter alia, by determining the contact angle of liquid drops of known surface tension and polarity and by evaluating the measurements by the method of Kaelble or Zismann (Römpp Lexikon Lacke und Druckfarben, Georg Thieme Verlag Stuttgart, 1998, page 416, "Surface tension"; CD Römpp Chemie Lexikon—Version 1.0, Stuttgart/New York; Georg Thieme Verlag 1995 "Wetting"). Other methods are known from "Lackadditive" [Additives for Coatings], Johan Bieleman, Weinheim, WILEY-VCH 1998, page 133 ff.

The process can be carried out with the normal coatings and coating materials that are known to the skilled worker. By way of example, mention may be made of alkyd resin coating materials, dispersion coating materials, epoxy resin coating materials, polyurethane coating materials, and acrylic resin coating materials. The coating materials may be used in liquid, paste or powder form. Nor are there any particular requirements imposed on the way in which these coating materials are applied. They may be applied, for example, by spraying, knife coating, brushing, flow coating, dipping or rolling.

In particular, the process can be carried out with coatings (A) cured with actinic radiation despite the fact that these are particularly highly crosslinked, apolar, unreactive and inert, and are therefore difficult to coat without the process of the invention.

Actinic radiation suitably includes electromagnetic radiation and corpuscular radiation. The electromagnetic radiation encompasses near infrared (NIR), visible light, UV radiation, X-rays, and gamma radiation, especially UV radiation. The corpuscular radiation encompasses electron beams, alpha radiation, proton beams, and neutron beams, especially electron beams.

Coatings (A) cured with actinic radiation are produced from coating materials (A) curable with actinic radiation, which, as is known, comprise radiation-curable, low molecular mass, oligomeric and/or polymeric compounds, preferably radiation-curable binders, based in particular on ethylenically unsaturated prepolymers and/or ethylenically unsaturated oligomers, further comprising, if desired, one or more reactive diluents, and also, if desired, one or more photoinitiators. Examples of suitable radiation-curable binders are (meth)acryloyl-functional (meth)acrylic copolymers, polyether acrylates, polyester acrylates, unsaturated polyesters, epoxy acrylates, urethane acrylates, amino acrylates, melamine acrylates, silicone acrylates, and the corresponding methacrylates. It is preferred to use binders which are free from aromatic structural units.

Suitable UV-curable coating materials (A) are disclosed in, for example, patents EP-A-0 540 884, EP-A-0 568 967 or U.S. Pat. No. 4,675,234. Further examples of suitable coating materials curable with actinic radiation include those known from, for example, German patent DE 197 09 467 C1, page 4, line 30, to page 6, line 30, or German patent application DE 199 47 523 A1.

Where the coating material (A) used is curable not only by actinic radiation but also thermally, i.e. is a dual-cure coating material, it preferably further comprises conventional thermosetting binders and crosslinking agents and/or thermosetting reactive diluents, as is described in, for example, German patent applications DE 198 187 735 A1 and DE 199 20 799 A1 or in European patent application EP 0 928 800 A1.

In the context of the present invention "thermal curing" means the heat-initiated curing of a film of a coating material, for which normally a separate crosslinking agent is employed. By those in the art this is commonly referred to as external crosslinking. Where the crosslinking agents are already incorporated in the binders, the term self-crosslinking is used. In accordance with the invention external crosslinking is of advantage and is therefore employed with preference.

The coating materials used to produce coatings (A) can also be used as coating materials (B). Otherwise it is also possible to use coating materials curable thermally and/or with actinic radiation. It is preferred to use the coating materials (A).

EXAMPLES

Example 1

Production of Coatings (A) and Determination of Surface Tension

A conventional UV-curable varnish (AI) consisting of:

| | |
|---|---|
| 35.31% by weight | Ebecryl ® 1290 (hexafunctional aliphatic urethane acrylate) |
| 35.31% by weight | Sartomer ® 494 (ethoxylated pentaerythritol tetraacrylate) |
| 8.65% by weight | hydroxypropyl acrylate |
| 0.98% by weight | Actilane ® 800 (radiation-curing silicone acrylate from Akcros Chemie) |
| 0.14% by weight | Dow Corning ® PA 57 (silicone additive from Dow Corning) |
| 0.42% by weight | Irgacure ® 819 (bisacylaphosphine photoinitiator) |
| 2.65% by weight | Genocure ® MBF (photoinitiator) |
| 1.12% by weight | Tinuvin ® 123 (aminoether HALS from Ciba Specialty Chemicals) |
| 1.40% by weight | Tinuvin ® 400 (UV absorber from Ciba Specialty Chemicals) |
| 5.09% by weight | ethyl acetate |
| 5.72% by weight | butyl acetate 98/100% |
| 3.21% by weight | isopropanol |

was cured first at RT for 20 min then for 1 min using a hand lamp (handlamp UV-H 250 from Kühnast Strahlungstechnik, Wächtersbach) at a distance of 30 cm, and subsequently in an IST inert unit at 14 m/s with power of 4×500 mJ/cm$^2$. This gave a coating (AI).

A conventional, UV- and heat-curable varnish (AII) consisting of the following constituents:

| Stock varnish: | |
|---|---|
| Methacrylate copolymer[a)] | 9 |
| Dipentaerythritol pentaacrylate | 20 |
| UV absorber (substituted hydroxyphenyltriazine) | 1.0 |
| HALS (N-methyl-2,2,6,6-tetramethylpiperidinyl ester) | 1.0 |
| Wetting agent (Byk ® 306 from Byk Chemie) | 0.4 |
| Butyl acetate | 27.4 |
| Solventnaphtha ® | 12.8 |
| Irgacure ® 184 (commercial photoinitiator from Ciba Specialty Chemicals) | 1.0 |
| Lucirin ® TPO (commercial photoinitiator from BASF AG) | 0.5 |
| Total: | 100 |

-continued

| Crosslinking component: | |
|---|---|
| Crosslinking agent 1: | |
| Isocyanatoacrylate Roskydal ® UA VPLS 2337 from Bayer AG (based on Trimeric hexamethylene diisocyanate; isocyanate group content 12% by weight) | 27.84 |
| Crosslinking agent 2: | |
| Isocyanatoacrylate Roskydal ® UA VP FWO 3003-77 from Bayer AG (based on trimer of isophorone diisocyanate (70.5% in butyl acetate; viscosity: 1500 mPas; isocyanate group content 6.7% by weight)) | 6.96 |
| Diluent | 3.48 |
| Total: | 38.28 |

a) The methacrylate copolymer was prepared by the following procedure:

A suitable reactor equipped with a stirrer, two dropping funnels for the monomer mixture and initiator solution, a nitrogen inlet tube, thermometer, heating and reflux condenser was charged with 650 parts by weight of an aromatic hydrocarbon fraction having a boiling range of 158 to 172° C. The solvent was heated to 140° C. Then a monomer mixture of 652 parts by weight of ethylhexyl acrylate, 383 parts by weight of 2-hydroxyethyl methacrylate, 143 parts by weight of styrene, 212 parts by weight of 4-hydroxybutyl acrylate and 21 parts by weight of acrylic acid was metered into the initial charge at a uniform rate over the course of four hours and an initiator solution of 113 parts by weight of the aromatic solvent and 113 parts by weight of tert-butylperethylhexanoate was metered into the initial charge at a uniform rate over the course of 4.5 hours. The metering of the monomer mixture and of the initiator solution was commenced simultaneously. After the end of the initiator feed, the resultant reaction mixture was heated with stirring at 140° C. for two hours more and then cooled. The resulting solution of the methacrylate copolymer (A) was diluted with a mixture of 1-methoxyprop-2-yl acetate, butylglycol acetate and butyl acetate was cured first at RT for 5 min, then for 10 min at 80° C., and subsequently for 20 min at 140° C. in an IST inert unit at 14 m/s with a power of 1500 mJ/cm$^2$. This gave a coating (AII).

The two coatings (AI) and (AII) were subjected to a contact angle measurement as per the Krüss GmbH Hamburg, Handbook "Drop Shape Analysis" in accordance with the method of Owens, Wendt, Rabel, and Kaeble at 23° C. and 50% relative atmospheric humidity, with the following measurement liquids: double-distilled water, 1,5-pentanediol, diiodomethane, ethylene glycol and glycerol, in each case with and without flaming, measurement taking place in each case immediately, after one day or after four days. The surface energy was calculated from the contact angles measured.

| Sample | Coating |
|---|---|
| 1 | AI, 5 min RT, no flaming |
| 2 | AII, flaming, measured immediately |
| 3 | AII, flaming, measured after 1 day |
| 4 | AII, flaming, measured after 4 days |
| 5 | AI no flaming |
| 6 | AI, flaming, measured immediately |
| 7 | AI, flaming, measured after 1 day |
| 8 | AI, flaming, measured after 4 days |

Flaming was carried out with an automatic flamer model S 4-S 300/2000 from Friedrich Schäfer Maschinenbaugesellschaft mbH, Sprendlingen, using a propane gas flame of 10 cm in width at a distance of 10 cm from the substrate, in one pass at an advancement rate of 150 m/s.

Table 2 lists the resultantly calculated surface energies of the correspondingly treated coatings (AI) and (AII).

TABLE 1

Contact angles

| Sample | Contact angle [°] | | | | |
|---|---|---|---|---|---|
| | $H_2O$ | Ethylene glycol | 1,5-Pentanediol | $CH_2I_2$ | Glycerol |
| 1 | 93 ± 0.4 | 75 ± 0.4 | 66 ± 0.2 | 61 ± 0.2 | 89 ± 1.4 |
| 2 | 42 ± 0.9 | 16 ± 4.4 | 19 ± 4.2 | 39 ± 1.3 | 43 ± 0.8 |
| 3 | 48 ± 1.3 | 22 ± 1.7 | 21 ± 1.6 | 40 ± 1.9 | 57 ± 1.4 |
| 4 | 57 ± 1.0 | 32 ± 1.0 | 32 ± 1.0 | 43 ± 0.9 | 61 ± 1.1 |
| 5 | 96 ± 0.8 | 84 ± 0.4 | 77 ± 0.2 | 70 ± 0.3 | 96 ± 0.5 |
| 6 | 44 ± 4.6 | 29 ± 4.3 | 35 ± 3.7 | 50 ± 1.3 | 48 ± 3.3 |
| 7 | 60 ± 9.5 | 41 ± 2.3 | 36 ± 1.0 | 52 ± 1.4 | 55 ± 6.3 |
| 8 | 66 ± 3.1 | 49 ± 1.2 | 49 ± 3.7 | 55 ± 0.8 | 59 ± 6.4 |

TABLE 2

Surface energies

| Sample | Surface energies [mJ/m²] | | |
|---|---|---|---|
| | Disperse component | Polar component | Total |
| 1 | 23.4 | 1.7 | 25.1 |
| 2 | 29.4 | 22.4 | 51.8 |
| 3 | 28.9 | 18.5 | 47.4 |
| 4 | 29.0 | 14.2 | 43.2 |
| 5 | 17.4 | 2.0 | 19.4 |
| 6 | 24.0 | 24.0 | 48.0 |
| 7 | 26.5 | 14.7 | 41.2 |
| 8 | 25.0 | 12.0 | 37.0 |

The results show an increase in the surface energy of the coatings (AI) and (AII), i.e., of the coating (A), as a result of the flaming, irrespective of whether the coating material was curable solely with actinic radiation or both thermally and with UV radiation. The increase is achieved in particular by raising the polar component of the surface energy.

Example 2

Overcoatability of the Coating (AI), Production of a Multilayer Coating

The overcoatability of the coating (AI) with itself was examined by means of a cross-cut test to DIN ISO 2409:1994-10. For this purpose the coating (AI) was overcoated with the varnish (AI), i.e., with itself, both after flaming and without flaming.

The abovementioned components constituting the UV-curable varnish (AI) were mixed with intensive stirring using a dissolver or a stirrer in order to prepare the corresponding varnish (AI). An applied film of this varnish (AI) was produced with a film thickness of 40±10 μm on a suitable test panel. The film was cured first at RT for 20 min, then for 1 min with a hand lamp UV-H 250 from Kühnast Strahlungstechnik, Wächtersbach, at a distance of 30 cm, and subsequently in an IST inert unit at 14 m/s with a power of 4×500 mJ/cm².

The cured varnish I (coating (AI)) (which becomes coating B) possessed a surface energy of 19.4 mJ/m².

Flaming was carried out as indicated above. The surface energy of the coating (AI) (which becomes coating A) was now 48.0 mJ/cm².

The quotient Q=B/A was therefore 0.41.

Subsequently the above-produced coating (AI) was covered in each case with a further film of varnish (AI) (coating material (B)) with a film thickness of 40±10 μm. The upper film was cured, as above, initially at RT for 20 min, then for 1 min with a hand lamp UV-H 250 from Kühnast Strahlungstechnik, Wächtersbach, at a distance of 30 cm, and subsequently in an IST inert unit at 14 m/s with a power of 4×500 mJ/cm².

In the case of the test panels without flaming that were investigated, cross-cut indexes of GT 4 or GT 5 were obtained. In contrast, the test panels treated by flaming gave cross-cut indexes of GT 0 or GT 1.

Example 3

Overcoatability of the Coating (AII), Production of a Multilayer Coating

The overcoatability of the coating (AII) with itself was examined in analogy to Example 2 above by means of a cross-cut test to DIN ISO 2409:1994-10. For this purpose the coating (AII) was overcoated with the varnish (AII), i.e., with itself, both after flaming and without flaming.

The cured varnish II (coating (AII)) (which becomes coating B) possessed a surface tension of 25.1 mJ/m².

Flaming was carried out as indicated above. The surface energy of the coating (AII) (which becomes coating A) was now 51.8 mJ/cm².

The quotient Q=B/A was therefore 0.5.

Subsequently the above-produced coating (AII) was covered in each case with a further film of varnish (AII) (coating material (B)) with a film thickness of 40±10 μm. The upper film was cured, as above, initially at RT for 5 min, then for 10 min at 80° C. and subsequently for 20 min at 140° C. in an IST inert unit at 14 m/s with a power of 1500 mJ/cm².

In the case of the test panels without flaming that were investigated, cross-cut indexes of GT 4 or GT 5 were obtained. In contrast, the test panels treated by flaming gave cross-cut indexes of GT 0 or GT 1.

Accordingly it has been shown that it is possible, surprisingly by means of the process of the invention to predict the success of producing the multilayer coating by setting the quotient Q.

What is claimed is:

1. A process for producing a multilayer coating for producing or refinishing an automotive (OEM) finish, in which a first coating (A) has applied to it a subsequent coating material (B) wherein at least one of coating (A), coating (B) or the combination of coating (A) and coating (B) is cured, the process which comprises at least one of selecting or modifying the first coating (A) or selecting the coating material (B) in such a way that the quotient (Q), calculated by dividing the surface energy of the second coating (B) by the surface energy of the first coating (A), is less than or equal to 1.

2. The process as claimed in claim 1, wherein the quotient (Q) is set by modifying the coating (A).

3. The process as claimed in claim 2, wherein the quotient (Q) is set by modifying the surface of the coating (A).

4. The process as claimed in claim 3, wherein the quotient (Q) is set by raising the surface energy of the first coating (A) by means of at least one of the following methods: low-pressure plasma technology, atmospheric-pressure plasma technology, flaming, fluorinating or silicatization.

5. The process as claimed in claim 1, wherein the quotient (Q) is set such that it is less than or equal to 0.95.

6. The process as claimed in claim 1, wherein the quotient (Q) is set such that it is less than or equal to 0.90.

7. The process as claimed in claim 1, wherein to set the quotient (Q) the surface energy of the first coating (A) is selected or changed such that it is <30 $mJ/m^2$.

8. The process as claimed in claim 1, wherein to set the quotient (Q) the surface energy of the first coating (A) is selected or changed such that it is <40 $mJ/m^2$.

9. The process as claimed in claim 1, wherein to set the quotient (Q) the surface energy of the first coating (A) is selected or changed such that it is <50 $mJ/m^2$.

10. The process as claimed in claim 1, wherein at least one of the coating (A) or the coating material (B) is cured by means of actinic radiation.

11. The process as claimed in claim 1, further comprising measuring the surface energy of the first coating (A) and the surface energy of the second coating (B).

12. The process as claimed in claim 11, wherein the quotient (Q) is set by modifying the coating (A).

13. The process as claimed in claim 12, wherein the quotient (Q) is set by raising the surface energy of the first coating (A) by means of at least one of the following methods: low-pressure plasma technology, atmospheric-pressure plasma technology, flaming, fluorinating or silicatization.

14. The process as claimed in claim 11, wherein the quotient (Q) is set such that it is less than or equal to 0.95.

15. The process as claimed in claim 11, wherein to set the quotient (Q) the surface energy of the first coating (A) is selected or changed such that it is <30 $mJ/m^2$.

16. The process as claimed in claim 11, wherein to set the quotient (Q) the surface energy of the first coating (A) is selected or changed such that it is <40 $mJ/m^2$.

17. The process as claimed in claim 11, wherein at least one of the coating (A) or the coating material (B) is cured by means of actinic radiation.

18. A process for producing a multilayer coating for at least one of producing or refinishing an automotive (OEM) finish, in which a first coating (A) has applied to it a subsequent coating material (B) wherein at least one of coating (A), coating (B) or the combination of coating (A) and coating (B) is cured, the process which comprises measuring the surface energy of the first coating (A) and the surface energy of the second coating (B), and at least one of selecting or modifying the first coating (A) or selecting the coating material (B) in such a way that the quotient (Q) formed from the surface energy of the second coating (B) and the surface energy of the first coating (A), and calculated by dividing the surface energy of the second coating (B) by the surface energy of the first coating (A), is less than or equal to 1.

* * * * *